US006335593B1

(12) United States Patent
Nakagawa

(10) Patent No.: US 6,335,593 B1
(45) Date of Patent: Jan. 1, 2002

(54) ELECTRIC DISCHARGE LAMP WITH AN IMPROVED SEALING STRUCTURE IMPROVING UNIFORMITY OF LIGHT OUTPUT AND METHOD OF MAKING

(75) Inventor: Atsuji Nakagawa, Himeji (JP)

(73) Assignee: Phoenix Electric Co., Ltd., Himeji (JP)

( * ) Notice: Subject to any disclaimer, the term of this patent is extended or adjusted under 35 U.S.C. 154(b) by 0 days.

(21) Appl. No.: 09/239,969

(22) Filed: Jan. 29, 1999

(30) Foreign Application Priority Data

Feb. 18, 1998 (JP) ..... 10-054278

(51) Int. Cl.[7] ..... H01J 17/18; H01J 9/32
(52) U.S. Cl. ..... 313/634; 313/623; 445/26
(58) Field of Search ..... 313/634, 573, 313/567, 25, 623; 445/26

(56) References Cited

U.S. PATENT DOCUMENTS 1,842,624 A * 1/1932 Morrison ..... 445/26

* cited by examiner

*Primary Examiner*—Michael H. Day
*Assistant Examiner*—Joseph Williams
(74) *Attorney, Agent, or Firm*—Oblon, Spivak, McClelland, Maier & Neustadt, P.C.

(57) ABSTRACT

An electric discharge lamp is provided comprising; a lamp envelop including a first and a second sealing tubes both of which are sealed and a light-emitting portion located between the sealing tubes; a pier of electrodes disposed in the light-emitting portion; and a filler substance encapsulated within the lamp envelop, one of the sealing tubes having a seal-cut trace of a tip tube that has been used for introducing the filler substance into the lamp envelop therethrough.

10 Claims, 4 Drawing Sheets

FIG. 1A
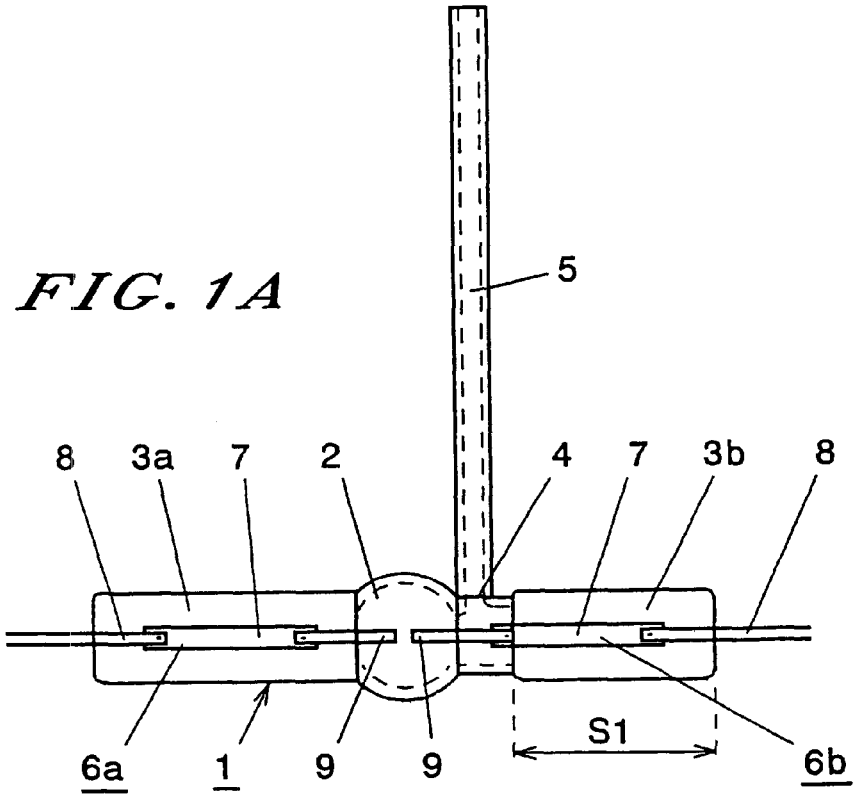
FIG. 1B
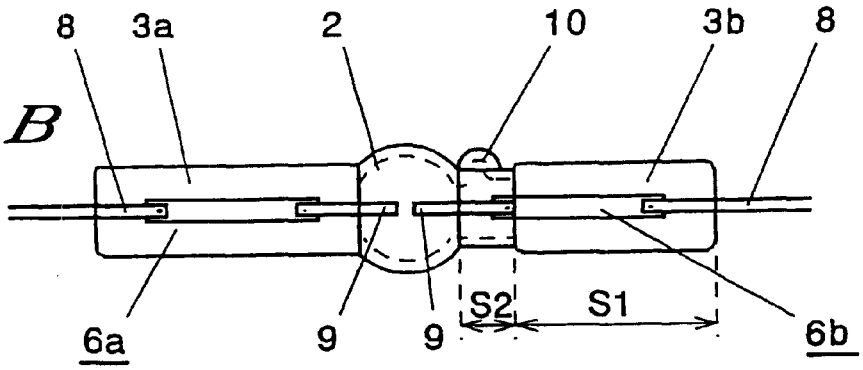
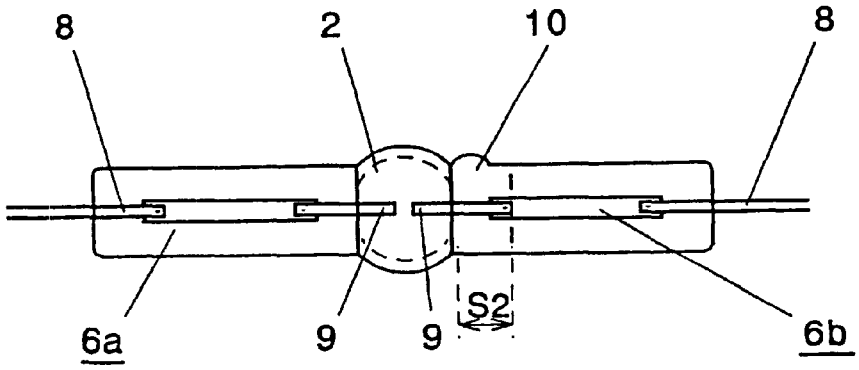
FIG. 1C

ELECTRIC DISCHARGE LAMP WITH AN IMPROVED SEALING STRUCTURE IMPROVING UNIFORMITY OF LIGHT OUTPUT AND METHOD OF MAKING

BACKGROUND OF THE INVENTION

1. Field of the Invention

The present invention relates to electric discharge lamps and, more particularly, to an improved sealing structure for use in such discharge lamps and a method for sealing discharge lamps.

2. Description of the Prior Art

Discharge lamps such as extra-high pressure mercury lamps and metal halide lamps are widely used in optical instruments such as liquid crystal projectors, OHPs and motion picture projectors and in general lightings. Such discharge lamps are highly advantageous in that their energy efficiency is three to five times higher than that of incandescent lamps such as halogen lamps, which emit light by heating filament, and their life time is five to ten times longer than that of such incandescent lamps.

A conventional method of making discharge lamps is briefly described with reference to FIGS. 2(A) and 2(B) illustrating such conventional method.

First, quartz glass is shaped into a glass tube (21) having a hollow light-emitting portion (22) and sealing tubes (23) formed at opposite ends of the light-emitting portion (22). Then, a hole (24) is formed at the light-emitting portion (22) of the glass tube (25) is connected to the hole (24).

Subsequently, a mount (26) having an electrode is inserted through an end of each sealing tube (23) into the glass tube (21) with use of a clamp, while nitrogen gas is introduced into the glass tube (21). The opposite sealing tubes (23) are then sealed by heating and pressing. Thus, the mount (26) is embedded in each sealing tube (23) so that the electrode is located in the light-emitting portion (22).

In turn, a vacuum is provided in the light-emitting portion (22) through the tip tube (25), followed by required treatments such as washing. Subsequently, filer substances such as mercury or a metal halide and a rare gas are filled into the light-emitting portion (22). The connecting portion of the tip tube (25) is then melt and cut to seal the light-emitting portion (22), thereby providing a discharge lamp.

With such method, however, a seal-cut trace (27) of the tip tube (25) remains on the light-emitting portion (22). The seal-cut trace hinders certain light path to cause a shadow, resulting a loss of 10 to 20% in lighting efficiency. Accordingly, when the discharge lamp is used as the light source of a projector or the like, unevenness in the screen brightness results.

Further, since the internal gas pressure if exerted on the light-emitting portion of the discharge lamp, the presence of the seal-cut trace (27) in the light-emitting portion is not preferable in terms of the strength. With the construction having such seal-cut trace, the filling gas pressure is limited, which leads to a lamp having a shorter life time.

To solve the problems associated with the seal-cut trace of the tip tube, so-called "tipless" discharge lamps which can be made without using any tip tube have been developed.

A conventional method of making such tipless discharge lamp is described below with reference to FIGS. 3(A) to 3(C).

First, a first mount (36*a*) is inserted through an outer end of one sealing tube (33*a*) into a glass tube (31) as shown in FIG. 3(A). The sealing tube (33*a*) containing the first mount (36*a*) therein is then sealed by heating and pressing.

Then, in a vacuum chamber capable of providing a highly reduced pressure, filler substances such as mercury and a rare gas are introduced through an outer end (37) of another sealing tube (33*b*) which is not yet sealed. Thereafter, a second mount (36*b*) having a bent lead (35) is inserted through the outer end (37) of the sealing tube (33*b*). The outer end (37) is then sealed by the use of a laser or a plasma burner, thus closing the glass tube (31) as shown in FIG. 3(B).

In this state, since the lead (35) of the second mount (36*b*) is bent, it abuts against the inner wall of the sealing tube (33*b*). Accordingly, although the second mount (36*b*) is located within a hollow portion of the sealing tube (33*b*), it can be retained without the aid of any additional retaining means.

The glass tube is then taken out of the vacuum chamber and the unsealed portion (i.e., the peripheral wall embracing the second mount) of the sealing tube (33*b*) is sealed by heating and pressing. The end portion (37) is then cut away as shown in FIG. 3(C), thus completing the tipless discharge lamp.

In the tipless discharge lamp thus fabricated, the seal-cut trace is not formed and, hence, the light path is not hindered. Thus the unevenness in brightness is less likely to occur. Further, since the lamp thus provided has an enhanced strength, the pressure within the light-emitting portion (32) can be greatly increased.

With this method, however, it is impossible to clean the interior of the glass tube through a tip tube which would otherwise be used after the sealing tube is sealed. Accordingly, impurities generated during such operations as encapsulating the rare gas and finally sealing the glass tube remain within the light-emitting portion (32), which may lead to any failure or a shorter life time.

Further, the cost of equipment such as the vacuum chamber and the like requires is high and, hence, the products are inevitably expensive. This hinders the widespread use of apparatus such as projectors using tipless discharge lamps.

Additionally, since the mount is retained within the glass tube by mere contact engagement between the lead (35) and the inner wall of the sealing tube (33*b*), the precise positioning of the electrode (36) is difficult, which leads to a poor yield.

Therefore, need exists for means for providing discharge lamps which is less likely to cause unevenness in brightness, which enables easier positioning of an electrode, and which ensure a longer life time at a low cost.

SUMMARY OF THE INVENTION

In accordance with a first aspect of the present invention, there is provided an electric discharge lamp comprising: a lamp envelop including a first and a second sealing tubes both of which are sealed and a light-emitting portion located between the sealing tubes; a pair of electrodes disposed in the light-emitting portion; and a filler substance encapsulated within the lamp envelop, one of the sealing tubes having a seal-cut trace of a tip tube that has been used for introducing the filler substance into the lamp envelop therethrough.

With this construction, the seal-cut trace of the tip tube is not located on the light-emitting portion, light emanates without interference by the seal-cut trace. Accordingly, the discharge lamp is less likely to suffer from a loss in the luminance and an unevenness in the brightness. Further, the light-emitting portion can be strengthened and hence, the pressure within the light-emitting portion can be increased thereby ensuring the lamp enjoying a longer life time.

In accordance with a second aspect of the present invention, there is provided a method of making a discharge lamp comprising the steps of: providing a lamp envelop including a first and a second sealing tubes, a light-emitting portion located between the sealing tubes, and a tip tube connected to the second sealing tube for communication therbetween; inserting a first mount having a first electrode into the first sealing tube through an open end thereof so that the first electrode is located in the light-emitting portion and then entirely sealing the first sealing tube; inserting a second mount having a second electrode into the second sealing tube through an open end thereof so that the second electrode is located in the light-emitting portion and then sealing a portion of the second sealing tube so as to maintain the communication between the tip tube and the second sealing tube; cleaning the inside of the light-emitting portion an then introducing a filler substance and a rare gas through the tip tube into the light-emitting portion; removing the tip tube from the second sealing tube by sealing and cutting; and sealing the rest of the second sealing tube in which a seal-cut trace of the tip tube is present.

With this method, the lamp envelop including the second sealing tube connected with the tip tube for communication therebetween is used, and accordingly, a discharge lamp is fabricated which has the seal-cut trace of the tip tube on the second sealing tube but not on the light-emitting portion. Further, since the mounts can be held firmly by clamp, the position of each electrode can be easily adjusted, which leads to a higher production yield.

Furthermore, this method allows the operations of reducing the pressure in the lamp envelop and introducing the filler substance such as mercury into the lamp envelop to be easily performed through the tip tube. Hence, a large vacuum chamber is not needed. Moreover, impurities within the lamp envelop can be discharged through the tip tube and, therefore, it is possible to provide discharge lamps which avoid any failure or any shortened life time associated with such impurities. In addition, the presence of the seal-cut trace of the tip tube on the second sealing tube but not on the light-emitting portion enables the filling gas pressure to increase rather than the conventional level, which leads to lamps enjoying a longer life time.

These and other objects, features and attendant advantages will become apparent from the following detailed description when read in conjunction with the attached drawing, in which;

BRIEF DESCRIPTION OF THE DRAWINGS

FIGS. 1(A) to 1(C) are each a schematic view illustrating a step of the process for making a discharge lamp according to the present invention;

DETAILED DESCRIPTION OF THE PREFERRED EMBODIMENT

Figure 2A:
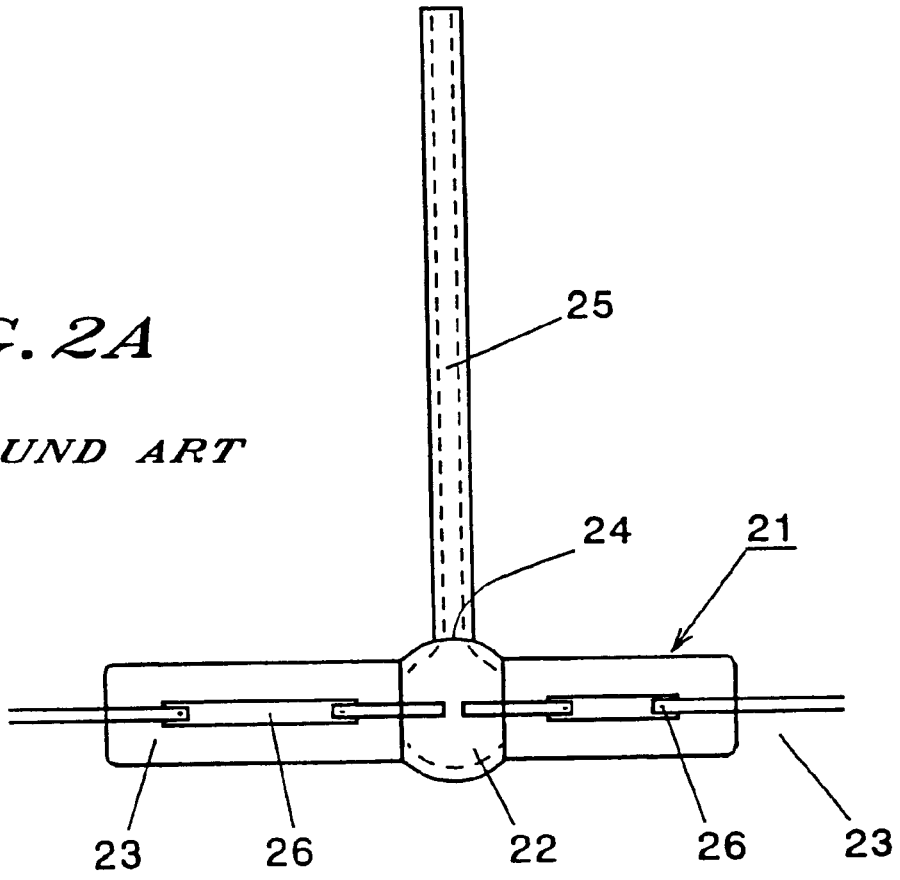
FIG. 2A BACKGROUND ART
FIGS. 2(A) and 2(B) are each a schematic view illustrating a step of the conventional process for making a discharge lamp.
Figure 2B:
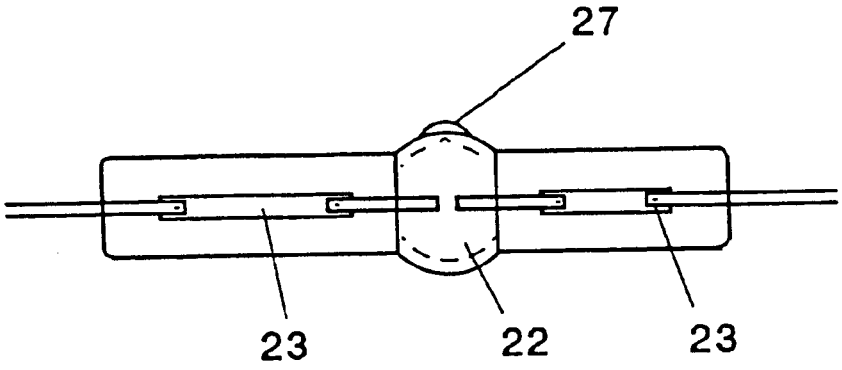
FIG. 2B BACKGROUND ART
Figure 3A:
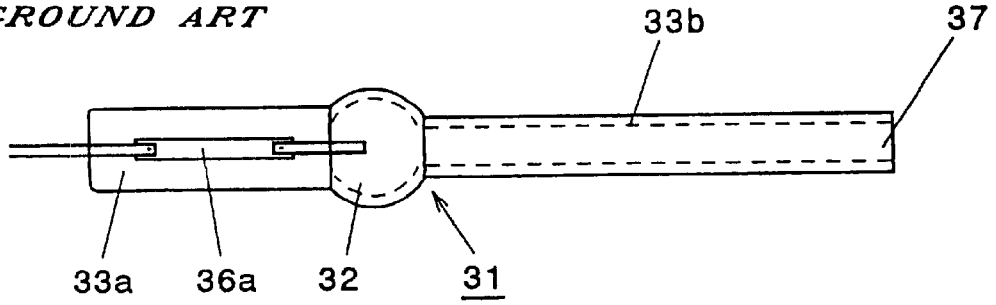
FIG. 3A BACKGROUND ART
FIGS. 3(A) to 3(C) are each a schematic view illustrating a step of the conventional process for making tipless discharge lamp.
Figure 3B:
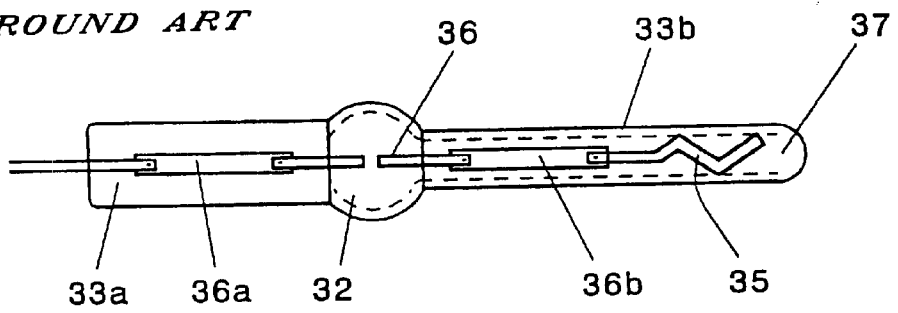
FIG. 3B BACKGROUND ART
Figure 3C:
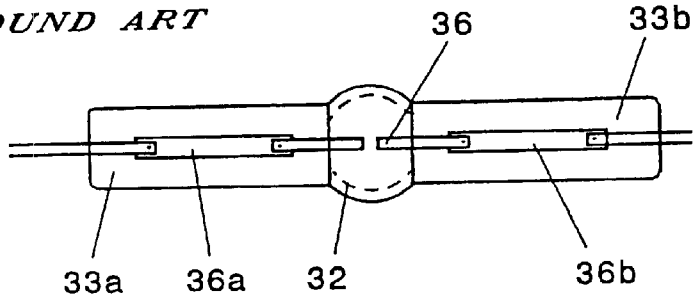
FIG. 3C BACKGROUND ART

The present invention will now be described in detail with reference to the accompanying drawings.

Referring to FIGS. 1(A) to 1(C) showing the procedure of making a discharge lamp according to the present invention, lamp envelop (1) formed of quarts glass is first provided comprising a hollow light-emitting portion (2) at a generally central portion thereof which is substantially spherical or shaped like a rugby ball, and cylindrical sealing tubes (3*a*) and (3*b*) situated on opposite sides of the light-emitting portion (2) which are to be finally sealed to become seal portions. Hereinafter, one of the sealing tubes is referred to as first sealing tube (3*a*) while the other sealing tube is referred to as second sealing tube (3*b*).

Next, hole (4) is made in a portion of the second sealing tube (3*b*), and a tip tube (5) is connected to the hole (4) by fusion bonding as shown in FIG. 1(A).

Then, first and second mounts (6*a*) and (6*b*) are inserted into the first and second sealing tubes (3*a*) and (3*b*), respectively, while $N_2$ gas is supplied into the lamp envelop (1).

Each of the mounts (6*a*) and (6*b*) comprises a sealing foil (7), a lead pin (8) welded to the sealing foil (7) and an electrode (9). Each mount is inserted into the lamp envelop (1) while holding the lead pin (8) of the mount (6) with a clamp so that the electrode (9) is located in the light-emitting portion (9). Since each mount is firmly held by the clamp, misalignment of the electrode and shifting of the mount is not likely to occur during the manufacture of the lamp.

The first sealing tube (3*a*) with the first mount (6*a*) inserted therein is then sealed by fusing and pinching so as to embed the first mount (6*a*) therein.

In turn, an outer portion (S1) of the second sealing tube (3*b*), which is located away from the light-emitting portion (2) than is the connecting portion of the tip tube (5), is sealed by fusing and pinching. Thus, the light-emitting portion (2) of the lamp envelop communicates with the outside only through the tip tube (5). In this embodiment, the spacing between the two electrodes is 1.3 mm.

Subsequently, the lamp envelop (1) is connected through the tip tube (5) to an evacuation device (not shown) so that the gas within the lamp envelop (1) is sucked out to reduce the pressure therein. Impurities generate during the sealing of the first sealing tube (3*a*) and the outer portion (S1) of the second sealing tube (3*b*) are discharged to the outside by this operation. By repeating the suction and introduction of $N_2$ gas the inside of the lamp envelop is cleaned, and thus the impurities in the lamp envelop can be easily removed.

After the tip tube (5) is removed from the evacuation device, predetermined amounts of mercury and a metal halide or a mercury halide, and argon gas and other inert gases are introduced through the tip tube (5) into the light-emitting portion (2). Then, the tip tube (5) is cut out by fusion to close the hole (4) as shown in FIG. 1(B). At this time, the light-emitting portion (2) of the discharge lamp (1) is cooled with, for example, liquid nitrogen to prevent the mercury and the like encapsulated in the discharge lamp (1) from evaporating.

The removal of the tip tube (5) leaves seal-cut trace (10) of the tip tube (5) on unsealed portion (S2) of the second sealing tube (3*b*). This portion (S2) including the seal-cut trace (10) is then sealed by fusing and pinching as shown in FIG. 1(C). As a result, the lamp envelop is reliably sealed with the seal-cut trace (10) made small and inconspicuous. Thus a discharge lamp is completed.

Five examples of such discharge lamp formed in accordance with this embodiment, five examples of conventional discharge lamp of the type having a seal-cut trace of a tip tube on the light-emitting portion and five examples of tipless discharge lamp were fabricated for comparison therebetween in brightness and in unevenness of screen brightness. Each of the discharge lamps is DC-powered on with use of an electronic ballast of 120 watts.

Table 1 shows the comparison in brightness, while Table 2 shows the comparison in unevenness of screen brightness. Unevenness (%) of screen brightness was obtained by measuring the highest luminance and the lowest luminance of unevenness and then calculating the ratio.

TABLE 1

| | Working distance (mm) | Aperture DIA (mm) | Total luminous flux |
|---|---|---|---|
| Prior Art | | | |
| No. 1 | 48 | 8 | 2980 |
| 2 | 48 | 8 | 2550 |
| 3 | 48 | 8 | 3120 |
| 4 | 48 | 8 | 2850 |
| 5 | 48 | 8 | 2620 |
| average | 48 | 8 | 2824 |
| Tipless lamps | | | |
| No. 1 | 48 | 8 | 3700 |
| 2 | 28 | 8 | 3650 |
| 3 | 48 | 8 | 3700 |
| 4 | 48 | 8 | 3500 |
| 5 | 48 | 8 | 3780 |
| average | 48 | 8 | 3666 |
| The Invention | | | |
| No. 1 | 48 | 8 | 3690 |
| 2 | 48 | 8 | 3750 |
| 3 | 48 | 8 | 3770 |
| 4 | 48 | 8 | 3550 |
| 5 | 48 | 8 | 3660 |
| average | 48 | 8 | 3684 |

TABLE 2

| | Visual observability | Extent of luminance unevenness (mm) | Luminance unevenness (%) |
|---|---|---|---|
| Prior Art | | | |
| No. 1 | noticeable | 70 | 75 |
| 2 | ditto | 70 | 70 |
| 3 | ditto | 50 | 80 |
| 4 | ditto | 70 | 70 |
| 5 | ditto | 80 | 60 |
| average | | 68 | 71 |
| Tipless lamps | | | |
| No. 1 | unnoticeable | 0 | 0 |
| 2 | ditto | 0 | 0 |
| 3 | ditto | 0 | 0 |
| 4 | ditto | 0 | 0 |
| 5 | ditto | 0 | 0 |
| average | | 0 | 0 |
| The Invention | | | |
| No. 1 | unnoticeable | 0 | 0 |
| 2 | ditto | 0 | 0 |
| 3 | ditto | 0 | 0 |
| 4 | ditto | 0 | 0 |
| 5 | ditto | 0 | 0 |
| average | | 0 | 0 |

As can be seen from Table 1 and 2, the discharge lamp in accordance with the present invention exhibits a brightness which is higher than that of the conventional discharge lamp having a seal-cut trace of a tip tube in the light emitting portion and which is substantially uniform.

Figure 4:
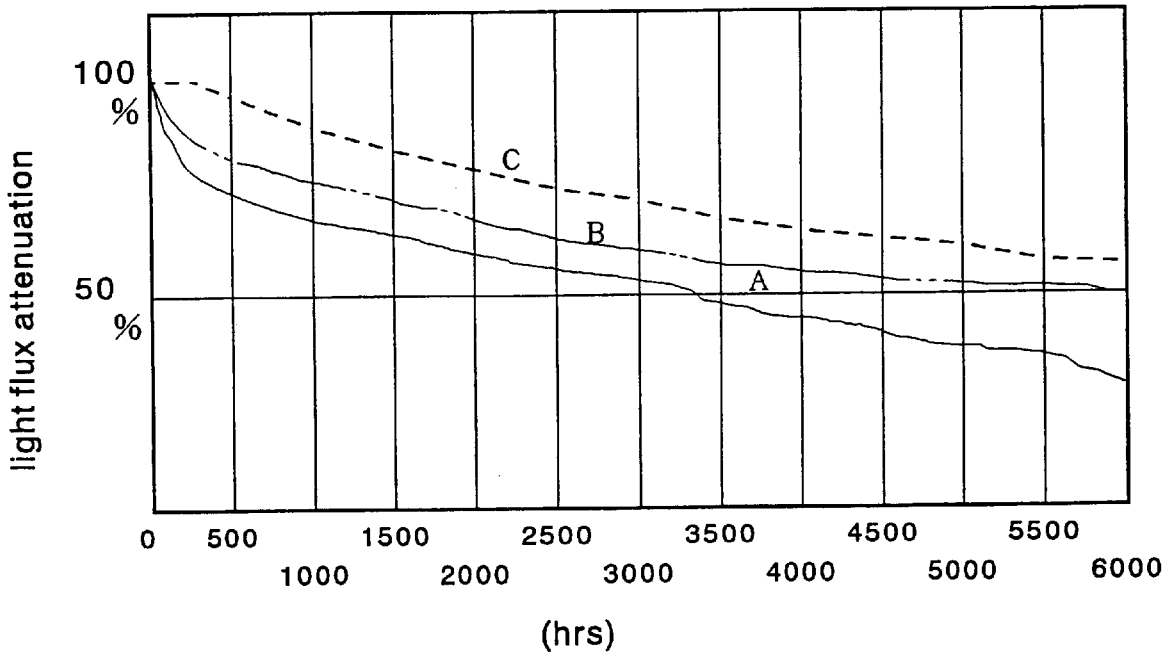
FIG. 4 is a graphic representation comparing the discharge lamp of the present invention and conventional ones in terms of life time (light flux attenuation)

Next, these lamps were subjected to a comparison test for attenuation of light flux to determine the life time of each lamp. The results are shown in FIG. 4. The initial light flux value of each lamp was assumed 100% and the light flux of light passed through an optical system was measured with lapse of time.

In FIG. 4 the line C indicates the attenuation of light flux of the discharge lamp according to the present invention, the line A indicates that of the conventional discharge lamp having a seal-cut race of a tip tube in the light emitting portion, and the line B indicates that of the tipless discharge lamp. As can be seen form FIG. 4, the discharge lamp in accordance with the present invention exhibits less attenuation of light flux than other lamps and hence enjoys a longer life time.

As can be seen from the above results, the discharge lamp in accordance with the present invention exhibits substantially the same performance as the tipless discharge lamp in brightness and evenness of brightness and enjoys a longer life time than tipless discharge lamp. Further, with the method of the present invention it is possible to provide such discharge lamps of good performance with a high yield and at a lower cost while reducing the cost for equipment.

As described above the present invention provides a discharge lamp which is free from unevenness of brightness, facilitates the positioning of the electrodes, enjoys a longer life time, and can be manufactured with a higher yield.

While only a presently preferred embodiment of the invention have been described in detail, as will be apparent with those familiar with the art, certain charges and modifications can be made in embodiment without departing form the spirit and scope of the invention as defined by the following claims.

I claim:

1. An electric discharge lamp comprising:

a lamp envelop including, first and second sealing tubes both of which are sealed, and a light-emitting portion located between the sealing tubes and configured to enclose an electric discharge during use;

a pair of electrodes with a part of the electrodes disposed in the light-emitting portion; and a filler substance encapsulated within the lamp envelop, wherein one of the sealing tubes has a seal-cut trace of a tip tube.

2. The lamp of claim 1, further comprising:

a first mount connected to a first of the pair of electrodes; and a second mount connected to a second of the pair of electrodes, wherein the first mount and the second mount are inserted into the first and second sealing tubes, respectively.

3. The lamp of claim 2, wherein each of the first mount and the second mount comprises:

a sealing foil; and a lead pin connected to the sealing foil, wherein the sealing foil is connected to one of the pair of electrodes and each of the first mount and the second mount is configured to hold an alignment and position of said one of the pair of electrodes during a manufacture of the lamp.

4. The lamp of claim 1, wherein the light-emitting portion has a central portion which is substantially spherical.

5. The lamp of claim 1, wherein the light-emitting portion has a central portion which is substantially ellipsoidal.

6. A method of making a discharge lamp comprising the steps of:

providing a lamp envelop including first and second sealing tubes, a light-emitting portion located between the sealing tubes and configured to enclose an electric discharge during use, and a tip tube connected to the second sealing tube for communication therebetween;

inserting a first mount having a first electrode into the first sealing tube through an open end thereof so that a part of the first electrode is located in the light-emitting portion and then entirely sealing the first sealing tube;

inserting a second mount having a second electrode into the second sealing tube through an open end thereof so that a part of the second electrode is located in the light-emitting portion and then sealing a portion of the second sealing tube so as to maintain the communication between the tip tube and the second sealing tube;

cleaning the inside of the light-emitting portion;

introducing a filler substance and a rare gas through the tip tube into the light-emitting portion;

removing the tip tube from the second sealing tube by sealing and cutting; and sealing a rest of the second sealing tube in which a seal-cut trace of the tip tube is present.

7. The method of claim 6, wherein the step of inserting a first mount comprises:

inserting a sealing fold, a lead pin connected to the sealing fold, and the first electrode into the first sealing tube.

8. The method of claim 6, wherein the step of inserting a second mount comprises:

inserting a second mount with a sealing fold, a lead pin connected to the sealing fold, and the second electrode into the second sealing tube.

9. The method of claim 6, wherein the step of providing a light-emitting portion comprises:

providing a light-emitting portion with a central portion which is substantially spherical.

10. The method of claim 6, wherein the step of providing a light-emitting portion comprises:

providing a light-emitting portion with a central portion which is substantially ellipsoidal.

* * * * *